US005270776A

United States Patent [19]

Landa

[11] Patent Number: 5,270,776

[45] Date of Patent: Dec. 14, 1993

[54] METHOD FOR FUSING DEVELOPED IMAGE

[75] Inventor: Benzion Landa, Edmonton, Canada

[73] Assignee: Spectrum Sciences B.V., Rotterdam, Netherlands

[21] Appl. No.: 202,687

[22] Filed: Jun. 6, 1988

[51] Int. Cl.[5] ..... G03G 21/00; G03G 15/10; G03G 15/20

[52] U.S. Cl. ..... 355/282; 355/290; 430/99; 430/124

[58] Field of Search ..... 430/99, 124; 355/282, 355/284, 286, 288, 289, 290, 293

[56] References Cited

U.S. PATENT DOCUMENTS

| | | | |
|---|---|---|---|
| 3,881,085 | 4/1975 | Traister | 355/288 X |
| 3,902,062 | 8/1975 | Eichorn | 355/286 X |
| 3,907,423 | 9/1975 | Hayashi et al. | 355/256 |
| 4,095,886 | 6/1978 | Koeleman et al. | 355/290 |
| 4,137,340 | 1/1979 | Verlinden et al. | 427/16 |
| 4,324,482 | 4/1982 | Szlucha | 355/290 X |
| 4,341,854 | 7/1982 | Lu | 430/124 |
| 4,411,976 | 10/1983 | Landa et al. | 430/114 |
| 4,474,456 | 10/1984 | Kobayashi et al. | 355/285 |
| 4,531,824 | 7/1985 | Landa | 355/285 |
| 4,538,899 | 9/1985 | Landa et al. | 355/291 |
| 4,639,405 | 1/1987 | Franke | 355/290 X |
| 4,698,290 | 10/1987 | Berkes | 430/124 |
| 4,708,460 | 11/1987 | Langdon | 355/290 X |
| 4,727,394 | 2/1988 | Bov et al. | 355/290 |
| 4,745,432 | 5/1988 | Langdon | 355/290 |
| 4,903,082 | 2/1990 | Dyer et al. | 355/290 |

FOREIGN PATENT DOCUMENTS

| | | | |
|---|---|---|---|
| 0254498 | 1/1988 | European Pat. Off. . | |
| 55-74571 | 6/1980 | Japan | 430/124 |

*Primary Examiner*—Fred L. Braun
*Attorney, Agent, or Firm*—Sandler Greenblum & Bernstein

[57] ABSTRACT

An imaging process which includes the steps of developing an image with liquid toner including a liquid carrier and toner particles, transferring the image to a substrate and fusing and fixing the image to the substrate by the application of energy and pressure, such that at least about 50% of the liquid carrier in the transferred image remains therein after fixing and fusing.

2 Claims, 3 Drawing Sheets

METHOD FOR FUSING DEVELOPED IMAGE

FIELD OF THE INVENTION

The present invention relates generally to an electrostatic imaging process employing liquid toner, including an improvement in the method of applying heat to the developed image while fusing and fixing.

BACKGROUND OF THE INVENTION

In known processes of electrostatic imaging, a image may be recorded in the form of an electrostatic latent image upon a photoconductive member. A developed image may then be obtained from the latent image by application of toner particles, which may be in the form of a finely powdered solid or a liquid dispersion.

In the electrostatic imaging process employing liquid toner, the basic steps are :

1. Generating an electrostatic latent image, e.g. on a photoconductive surface such as a plate or drum which has been sensitized by charging with a corona discharge and by exposure to light in the form of an image of an object— the charge is dissipated in exposed areas;
2. Developing the latent image by contact with a liquid dispersion ("toner") of fine particles which in a positive process are attracted to the charged areas and which in a reverse process are attracted to the uncharged areas;
3. Removal of excess liquid toner and particles from the background areas;
4. Transfer of the image, e.g. to a substrate such as paper, under influence of an electrical field;
5. Fixing the image by fusing the particles together and to the substrate; and
6. Cleaning the plate or drum for reuse.

In this connection reference is made to the following issued U.S. patents in the field of electrophotography: U.S. Pat. Nos. 3,990,696, 4,233,381, 4,253,656, 4,256,820, 4,269,504, 4,278,884, 4,286,039, 4,302,093, 4,326,644, 4,326,792, 4,334,762, 4,350,333, 4,355,883, 4,362,297, 4,364,460, 4,364,657, 4,364,661, 4,368,881, 4,378,422, 4,392,742, 4,396,187, 4,400,079, 4,411,976 4,412,383, 4,413,048, 4,418,903, 4,420,244, 4,435,068, 4,439,035, 4,454,215, 4,460,667, 4,473,865, 4,480,825, 4,501,486, 4,522,484, 4,531,824, 4,538,899, 4,582,774, 4,585,329, 4,586,810, 4,589,761, 4,598,992, 4,603,766, 4,620,699, 4,627,705 and 4,678,317, the disclosures of all of which are incorporated by reference herein.

Following development, the excess liquid toner and particles are removed from the image, by a step often referred to as "metering". This step may be carried out by use of an electrically biased reverse roller which also shears off the "fluffy" part of the imaged regions. At the transfer stage, there is likely to occur a degree of smudging, smearing or squashing of the image, which detracts from its quality.

In published UK patent application GB 2169416A (Landa et al), the disclosure of which is incorporated herein by reference, a degree of squash-resistance is imparted to the developed image by using fibrous toner particles which may be prepared as follows: a thermoplastic polymer (and pigment) is plasticized with a nonpolar liquid, preferably at elevated temperature, to form a sponge, the sponge is shredded, more nonpolar liquid is added, the pieces of shredded sponge are wetground into particles and the grinding is continued to pull the particles apart to form fibers extending therefrom (the particles preferably having a diameter less than 5 microns). Finally, a charge director may be added to impart a charge of predetermined polarity to the toner particles.

In an alternative method of preparation which is also the subject of published UK patent application GB 2176904A (Landa et al), the disclosure of which is incorporated herein by reference, a thermoplastic polymer is plasticized at an elevated temperature with a nonpolar liquid, a pigment is stirred into the plasticized polymer to disperse it therein, stirring is continued to prevent the formation of a sponge while reducing viscosity of the mixture by adding additional nonpolar liquid to form a dispersion, cooling while continuing stirring to permit the precipitation of pigmented polymer (toner) particles having a plurality of fibers and withdrawing the dispersion having a concentration of toner particles from the mixing step. Charge director may be added as before.

It is self-evident that the principal difference between the content of the toner image formed with dry toner and that formed with liquid toner, is that the toner image formed with liquid toner contains the solvent, usually a hydrocarbon solvent, in which the toner particles are suspended, this solvent being absent from the image formed using dry toner. In order to produce a visible image when using a liquid toner, which resembles the image obtained when using a solid toner, the prior art which relates to fusing and fixing a developed image by the application of heat thereto assumes the simultaneous removal by evaporation of the toner solvent.

Thus, in U.S. Pat. No. 4,474,456 (Kobayashi et al), which relates to a heat-fixing device including a heat plate along which transfer medium bearing thereon a toner image is advanced during which the toner image becomes fixed to the transfer medium by fusing, it is stated that in an electrophotographic copying machine of the wet-development type, a sufficient amount of thermal energy must be applied to the transfer medium to remove the carrier liquid impregnated into the transfer medium by evaporation.

Published European Patent Application 0247248A1 discloses a process in which an electrostatic charge pattern is developed with liquid toner and the developed image is fixed by the simultaneous application of heat and pressure, characterized by the fact that the toner particles have a particular melt viscosity in the dry state. The disclosure contemplates evaporation during fixing of a substantial part of the carrier liquid, removal of the vapors thus produced by suction or by pressurized entrainer gas, and disposal of the removed vapors by adsorption or absorption, condensation or combustion.

Published European Patent Application 0244198A2 describes and claims a reproducing machine (and a corresponding method) including apparatus for applying heat to sheet material having a liquid-developed image thereon to remove substantially all of the liquid carrier transferred thereto so as to dry the sheet of support material and at least partially melt the pigmented particles transferred thereto, as well as apparatus for generating heat to the pigmented particles so as to fuse them to the support in image configuration.

U.S. Pat. No. 4,727,394 (Bov et al) claims a reproducing machine incorporating a hot fusing roll cooperating with a pressure roll to apply heat and pressure to a developed image on a sheet of support material so as to vaporize substantially of the liquid carrier transferred thereto and to substantially permanently fuse the pigmented particles to the sheet of support material.

The disadvantage of these prior art methods is that removal of organic solvent from the developed image as recited therein creates a pollution problem in the immediate environment, which must be countered, if pollution is to be avoided, by taking special measures as set out in above-mentioned published European Patent Application 0247248A1, namely by adsorption or absorption, condensation or combustion.

SUMMARY OF THE INVENTION

It is a principal object of the present invention to avoid the pollution problem just mentioned, in an electroimaging process utilizing liquid toner.

Another object of the invention is to avoid the additional cost and inconvenience of having to absorb, condense or burn off the organic solvent vapors, in the above-mentioned prior art processes.

Yet another object of the invention is to employ a step of fusing a fixing a liquid-developed image in an electrostatic imaging process, by the employing of heat, while nevertheless avoiding the disadvantages mentioned in relation to the prior art described above. Other objects of the invention will become apparent as the description proceeds.

There is thus provided in accordance with a preferred embodiment of the present invention in an imaging process which includes the steps of developing an image with liquid toner including a liquid carrier, fusing and fixing the image by the application of energy thereto, the improvement including preselecting at least the energy applied upon fusing and fixing and the properties of the liquid carrier, such that the liquid carrier is not substantially removed upon fixing and fusing.

Preferably a major part of the liquid carrier is not removed upon fixing and fusing. In a preferred embodiment, at least 50% weight of the liquid carrier is not evaporated upon fixing and fusing.

In accordance with a preferred embodiment of the present invention there is provided in an electrostatic imaging process which comprises the steps of developing an electrostatic image with liquid toner including at least pigmented thermoplastic polymer particles and a liquid carrier, transferring the developed image to a substrate and subsequently fusing and fixing the substrate-supported developed image by the application of heat from the surface of an elastomer-coated first roller thereto, said surface being lubricated and said substrate being transported through a nip defined by a portion of the surface of said first roller and a portion of the surface of a second elastomer-coated roller located on the reverse side of the substrate, the improvement comprising pre-selecting at least the following conditions, namely, the temperature at which the fusing and fixing is effected, the rate of transport of the substrate, and the properties of the liquid carrier, such that the liquid carrier is not all substantially removed from the substrate-supported image.

BRIEF DESCRIPTION OF THE DRAWINGS

The present invention will be understood and appreciated more fully from the following detailed description taken in conjunction with the drawings, in which.

DETAILED DESCRIPTION OF THE INVENTION

Figure 1:
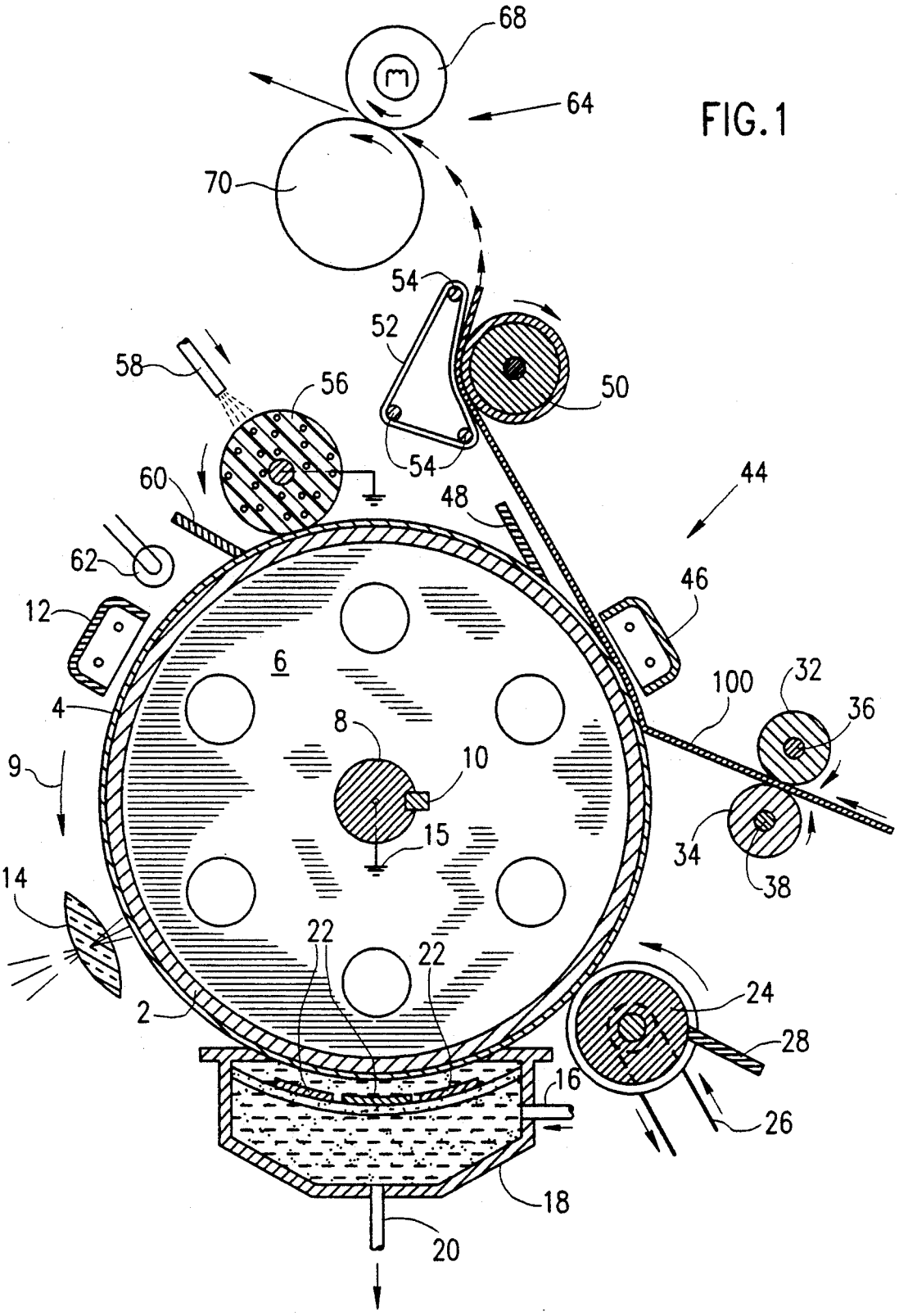
FIG. 1 is a schematic illustration of electrostatic imaging apparatus, which may be employed for effecting the process of the invention in accordance with a particular embodiment thereof.

Reference is made to FIG. 1 in which there is shown electrostatic imaging apparatus employing a liquid toner. The apparatus includes a metal drum 2 which carries a photoconductor 4 and which is mounted by disks 6 onto a shaft 8. The disks are secured to shaft 8 by a key 10 so that the shown drum assembly, which is provided in a light-proof housing (not shown), is operative to rotate with shaft 8.

Shaft 8 is driven in any appropriate manner (not shown) in the direction of arrow 9 past a corona discharge device 12 operative to charge the surface of photoconductor 4. The image to be reproduced is projected onto the charged photoconductor by an optical system 14. Since shaft 8 is grounded at 15 and disks 6 are conductive, the areas struck by light conduct the charge, or a portion thereof, to ground, thus forming on the photoconductor an electrostatic latent image.

The liquid toner is circulated from any suitable source (not shown) through a pipe 16 into a development tray 18 from which it is drawn through a pipe 20 for recirculation. Development electrodes 22, which may be appropriately biased as known to the art, assist in toning the electrostatic latent image as it passes into contact with the toner.

As the amount of liquid on the photoconductor surface is normally too great for satisfactory subsequent transfer of the developed image, a roller 24, whose surface moves in a direction opposite to that of the photoconductor surface, is spaced from the photoconductor surface and is operative to shear excess liquid from the developed image without disturbing it. An exemplary roller is shown in U.S. Pat. No. 3,907,423, the disclosure of which is incorporated herein by reference.

Roller 24 is driven, typically by a drive belt 26 which is in turn driven by any appropriate, known speed-controllable motor means (not shown). The roller is kept clean by a wiper blade 28.

A pair of register rollers 32 and 34 is operative to feed to a transfer station, referenced generally 44, a carrier sheet 100, which is to receive the developed image. At transfer station 44, a corona discharge device 46 is operative to impress upon the rear of the carrier sheet a charge of polarity opposite to that of the toner particles forming the developed image. The developed image is thus drawn towards the carrier sheet.

Rollers 32 and 34 are mounted onto and secured for rotation with respective axles 36 and 38. The axles are driven in synchronism so that there is not relative motion between the points of closest approach of the rollers 32 and 34 to each other. Alternatively, if desired, only one of the register rollers need be driven.

A pick-off member 48 assists in the removal from the photoconductor of the carrier sheet bearing the developed image. A roller 50 coating with a plurality of flexible bands 52 mounted onto a plurality of rollers 54 delivers the carrier sheet to fusing and fixing apparatus, referenced generally 64. Apparatus 64 is described below in greater detail in conjunction with FIG. 2.

A cleaning roller 56, formed of an appropriate synthetic resin as known in the art, is driven in a direction opposite to that of photoconductor 4, so as to scrub clean the surface thereof. To assist in this action, insulating, nonpolar, nontoxic liquid may be fed through a pipe 58 to the surface of the cleaning roller 56. A wiper blade 60 completes the cleaning of the photoconductive surface. Any residual charge left on the photoconductive drum is extinguished by flooding the photoconductor surface with light from a lamp 62.

Figure 2:
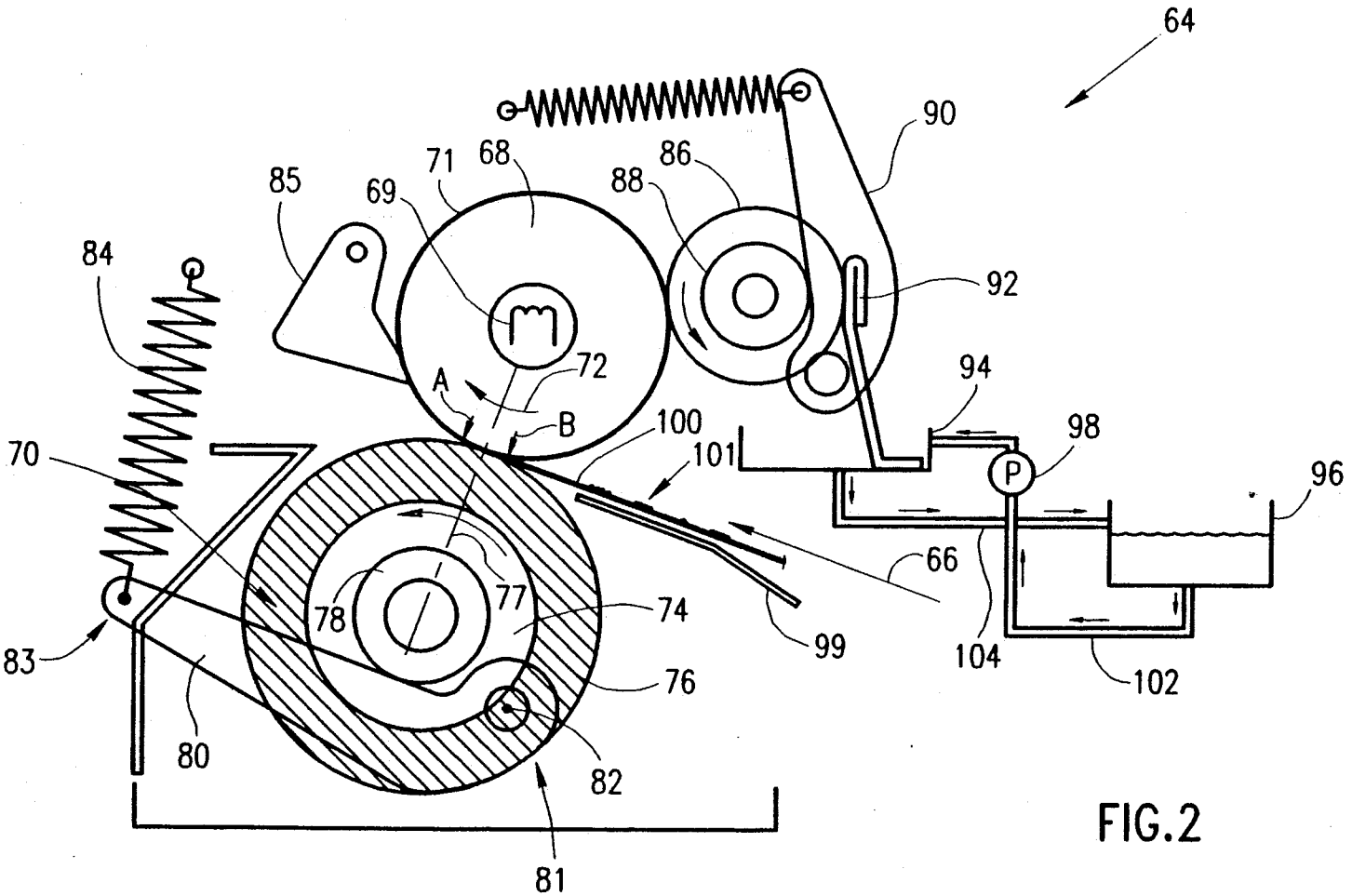
FIG. 2 is a more detailed schematic illustration of apparatus for fusing and fixing a developed image onto a carrier sheet, useful in the apparatus of FIG. 1.

Reference is now made to FIG. 2 in which there is shown fusing and fixing apparatus, constructed and operative in accordance with a preferred embodiment of the invention. Carrier sheet 100 is fed in the direction of an arrow 66 and, with the assistance of a guide member 99, between a heated roller 68 and a pressure roller 70.

In the shown embodiment, roller 68 is driven by any suitable means (not shown) and, as it rotates in a direction shown by arrow 72, it is also operative to cause rotation of roller 70 by friction. Roller 68 typically comprises a hollow metal cylindrical core in which is provided a heat source 69 which helps in fusing the developed image borne by the carrier sheet as it is drawn between rollers 68 and 70.

The metal core of roller 68 is coated with a thin layer 71 of a synthetic elastomer material having a hardness value of not greater than about 50 on the Shore A scale. A typical synthetic material is silicone rubber. It is preferred that the composition of the synthetic material of which layer 71 is formed is such that the occurrence of offset of a developed image coming into contact with the layer is negligible.

Roller 70 comprises a cylindrical metal core 74 onto which there is mounted a sleeve 76 of a synthetic elastomer material having a hardness value of not greater than about 50 on the Shore A scale. A typical synthetic material is silicone rubber. The hardness of the material of sleeve 76 may be less than that of the material of layer 71; alternatively or additionally, the ratio of the thickness of layer 71 to thickness of sleeve 76 may be less than 1, and is preferably in the less than 1 to 10. For example, layer 71 may be 0.4 mm thick and sleeve 76 may be 20 mm thick.

Due to the difference in respective thickness of layer 71 and sleeve 76, roller 68 is much less resilient than roller 70. Consequently, when roller 68 presses against roller 70 along an axis 77, the surface of roller 70 becomes indented and a continuous contact length or 'nip' is formed between the rollers and between two points indicated by arrows A and B.

It may be appreciated that as the carrier sheet is drawn into the nip, it is of great importance in ensuring that effective fusing and fixing of the image on the sheet takes place without the image being squashed, smeared or smudged. There is provided, therefore, apparatus for adjusting the pressure between rollers 68 and 70.

While roller 68 preferably rotates about a fixed axis, roller 70 is mounted for rotation onto an adjustable axle 78 which is supported by a support arm 80. Support arm 80 is rotatably mounted at one end 81 thereof, about a fixed axis 82 and is further supported, at another end 83 thereof, by a spring 84. It will be appreciated that the stronger the spring, the greater the pressure that is imposed by roller 70 onto roller 68.

As the carrier sheet as drawn between rollers 68 and 70, heat applied to the sheet from source 69 is effective, in combination with the pressure applied to the sheet by the rollers, to fuse and fix the developed image onto the sheet. According to the shown embodiment, the sheet is fed between the rollers such that the developed images, shown generally at 101, contacts the surface of roller 68. Although it is greatly to be preferred that layer 71 has a material composition that virtually eliminates offset while not giving rise to squashing, smudging or smearing of the developed image when used in a liquid toner process, there is provided, nonetheless, a stripper 85 for ensuring paper removal.

Thus, in accordance with an embodiment of the invention and with reference to FIGS. 1 and 2, an electrostatic imaging process includes the steps of generating a latent electrostatic image on photoconductor 4, developing the latent image with liquid toner from bath 18, transferring the developed image to carrier sheet 100 and fusing and fixing the transferred image on the substrate by heat and pressure applied thereto preferably by passing it between rollers 68 and 70.

With further reference to FIG. 2, there is also provided apparatus for wetting heated roller 68 with silicone oil, such as 350° F. The shown wetting apparatus comprises a wetting roller 86 which is mounted onto an adjustable axle 88, roller 86 being operative to rotate together with heated roller 68. There is also provided a spring-retained arm 90 which maintains contact between wetting roller 86 and roller 68 by applying pressure onto axle 88 in the direction of roller 68.

Wetting roller 86 is kept moist by a liquid absorbing element 92 which communicates with an oil trough 94 and which is maintained in touching contact with roller 86. Element 92 may, for example, comprise a layer of velvet mounted on a support. Oil trough 94 is supplied with silicone oil to a depth that is sufficient to keep element 92 damp enough so as to moisten wetting roller 86. Oil is provided to trough 94 from an external reservoir 96 and is pumped therefrom at a very slow rate, by means of a pump 98 and an entry conduit 102. Excess oil in trough 94 drains therefrom back into reservoir 96 via an outlet conduit 104.

Figure 3:
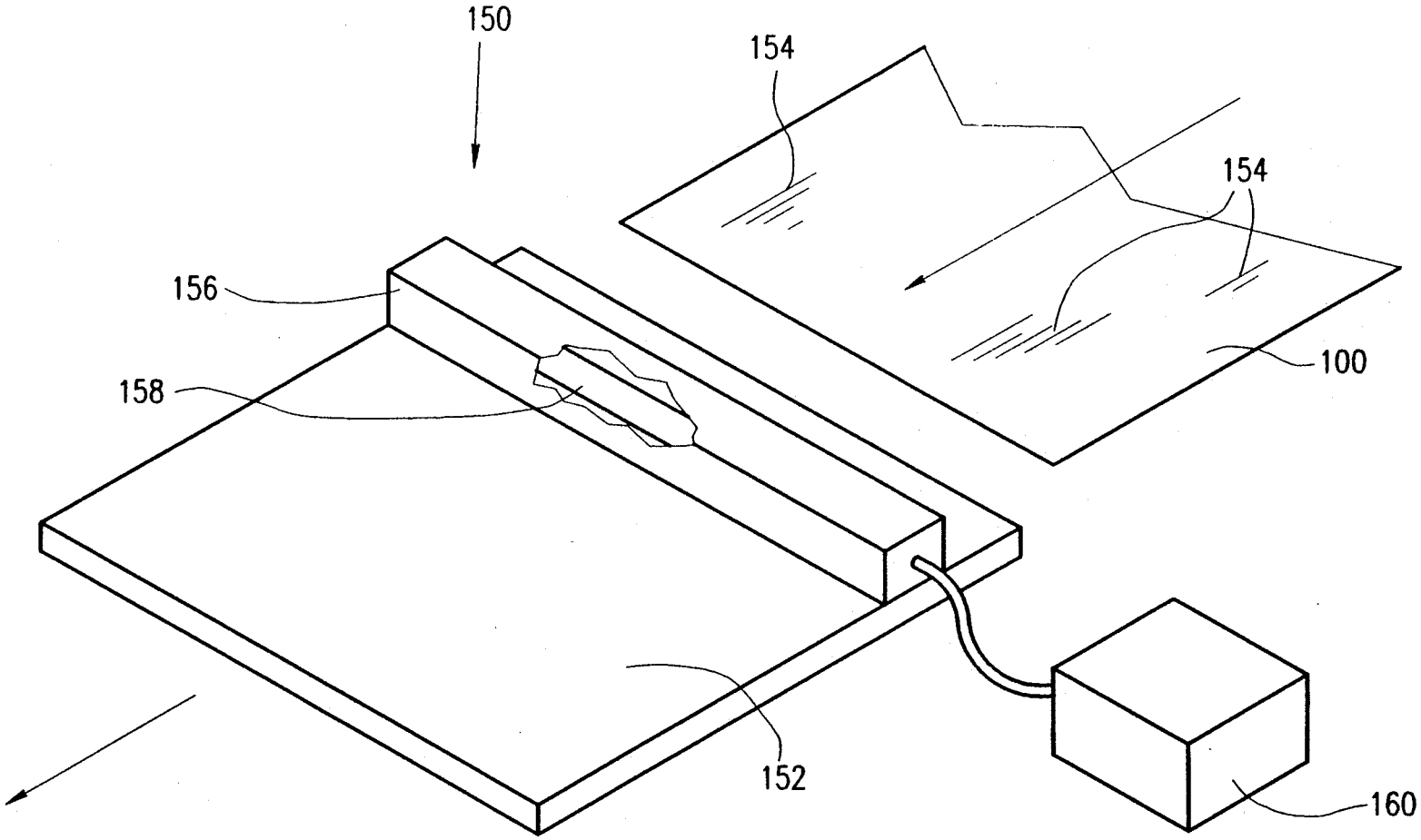
FIG. 3 is a schematic illustration of a detail of electrostatic imaging apparatus, which may be employed for effecting the process of the invention in accordance with an alternative embodiment thereof.

Reference is now made to FIG. 3 in which there is schematically illustrated a flash fuser, referenced generally 150. Flash fuser 150 comprises a platen 152 along which carrier sheet 100 is conveyed, as indicated, for fusing and fixing a developed image, shown by shaded areas 154, onto sheet 100. A housing 156 encloses a flash lamp 158 which is energized by a suitable conventional power supply 160. The light energy emitted by the flash lamp 158 is absorbed by the image on carrier sheet 100, causing fusing of the image onto the carrier sheet.

It is a feature of the invention that substantial evaporation of the liquid carrier in the developed image and otherwise present on the sheet does not occur during fixing and fusing and at least a large portion of the liquid carrier has been found to remain in the sheet when selecting the carrier liquid and flash energy in accordance with the invention.

It will be appreciated by persons skilled in the art that other methods of thermal fusing may be used in place of flash fuser 150 and roll fuser 64 in accordance with the present invention.

A suitable toner solution for the process of the present invention may be prepared as follows. ELVAX II 5720 (Dupont) (1000 g.) and ISOPAR L (Exxon) (500 g.) are mixed together at a temperature of 90°±10° C.

for 1 hour, using a Ross Double Planetary mixture. Carbon black (Mogul L (Cabot), 250 g.) and ISOPAR L (500 g.) are added, and mixing is continued for 1 hour. ISOPAR L (2000 g.), preheated to 110° C. is added, and mixing is continued for a further 1 hour. The source of heat is withdrawn, while continuing mixing until the temperature has fallen to less than 40° C. Of the resultant mixture, 3050 g. are milled at a temperature of 40°±2°-3° C. for about 22 hours with ISOPAR L (4000 g.) in a Sweco M18 Vibratory Mill containing 0.5" alumina cylinders. The product is a 12.5% solids concentrate; a working dispersion is obtained by diluting with ISOPAR L to a 1.5% solids content. In the Examples which follow, the Savin 870 photocopier requires 1.5 kg. of this working solution, to which is added 7-8 ml. of 10% lecithin in ISOPAR L as charge director, while the Savin V45 photocopier requires 0.8 kg. of this working solution, to which is added 3.5-4 ml. of 10% lecithin in ISOPAR L as charge director.

Elvax II type 5720 solvates substantial amounts of ISOPAR L (and is thereby plasticized) at temperatures in the range of about 65° C. to 100° C. In the method of toner manufacture described above, a temperature of between 70° C. and 90° C. is used.

The non-volatile portion of the toner solution has a viscosity of not less than $2\times10^6$ centipoise at a temperature of 121°±1° C.

The invention will now be illustrated by the following non-limitative Examples.

EXAMPLE 1

A Savin V45 photocopier which was modified to incorporate at the fixing and fusing stage a hot roller system as described above at an optimum temperature of 120°±10° C. for minimum offset, was operated with a substrate speed of about 314 mm./sec., with a pressure applied at each side of the pair of rollers of 6 kg., using the liquid toner prepared as above. The length of the nip was about 4-6 mm. Under these conditions the major part of the ISOPAR L in the toner image was retained therein, while fusing and fixing was achieved.

EXAMPLE 2

A Savin 870 photocopier, having its internal fuser rendered inoperative, was used to generate copies on paper using the liquid toner prepared as described hereinabove. The copies were then subjected to flash illumination of about 0.75 Joule/cm$^2$ and 400 microsecond pulse duration. Under these conditions the major part of the ISOPAR L in the toner image was retained therein, while fusing and fixing was achieved.

It will be appreciated by persons skilled in the art that the present invention is not limited to what has been particularly shown and described hereinabove. The scope of the present invention is limited, rather, solely by the claims which follow:

I claim:

1. In an electrostatic imaging process which comprises the steps of developing an electrostatic image with liquid toner including pigmented thermoplastic polymer particles and a liquid carrier, transferring the developed image to an image bearing surface of a substrate and fusing and fixing the substrate-supported developed image by the application of heat from the surface of an elastomer-coated first roller thereto, said substrate being transported through a nip defined by a portion of the surface of said first roller facing said image bearing surface and a portion of the surface of a second elastomer-coated roller, the improvement comprising pre-selecting at least the following conditions, namely, the temperature at which the fusing and fixing is effected, the rate of transport of the substrate, and the properties of the liquid carrier, such that less than about half of the liquid carrier present in the transferred image is removed during fusing and fixing.

2. A process according to claim 1 also including the step of coating the surface of said first roller with a silicone oil.

* * * * *